US007924247B2

(12) United States Patent
Park et al.

(10) Patent No.: US 7,924,247 B2
(45) Date of Patent: Apr. 12, 2011

(54) DISPLAY DEVICE AND DRIVING METHOD THEREOF

(75) Inventors: Kee-Chan Park, Suwon-si (KR); Il-Gon Kim, Seoul (KR); Ho Suk Maeng, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 785 days.

(21) Appl. No.: 11/347,586

(22) Filed: Feb. 4, 2006

(65) Prior Publication Data

US 2006/0176251 A1 Aug. 10, 2006

(30) Foreign Application Priority Data

Feb. 7, 2005 (KR) ..... 10-2005-0011224

(51) Int. Cl.
*G09G 3/30* (2006.01)

(52) U.S. Cl. ..... 345/76; 345/55; 345/45

(58) Field of Classification Search ..... 345/73–86, 345/45, 55; 315/169.3
See application file for complete search history.

(56) References Cited

U.S. PATENT DOCUMENTS

| | | | | |
|---|---|---|---|---|
| 5,723,950 | A | 3/1998 | Wei et al. | |
| 5,739,804 | A | 4/1998 | Okumura et al. | |
| 5,892,493 | A * | 4/1999 | Enami et al. | 345/94 |
| 6,064,363 | A | 5/2000 | Kwon | |
| 6,121,943 | A | 9/2000 | Nishioka et al. | |
| 7,057,589 | B2 * | 6/2006 | Shin et al. | 345/82 |
| 2003/0218594 | A1 * | 11/2003 | Ishii | 345/96 |
| 2004/0036457 | A1 * | 2/2004 | Tokioka et al. | 323/281 |
| 2004/0070557 | A1 * | 4/2004 | Asano et al. | 345/76 |
| 2005/0001795 | A1 * | 1/2005 | Kitahara | 345/76 |
| 2005/0110730 | A1 * | 5/2005 | Kim et al. | 345/82 |
| 2006/0043366 | A1 * | 3/2006 | Ha et al. | 257/59 |

FOREIGN PATENT DOCUMENTS

| | | |
|---|---|---|
| CN | 1169787 | 1/1998 |
| CN | 1534568 | 10/2004 |
| CN | 1547183 | 11/2004 |
| CN | 1622174 | 6/2005 |
| JP | 11-311970 | 11/1999 |
| KR | 1020030004774 | 1/2003 |
| KR | 1020030075946 | 9/2003 |
| KR | 1020040060140 | 7/2004 |
| KR | 1020040063521 | 7/2004 |

* cited by examiner

*Primary Examiner* — Amare Mengistu
*Assistant Examiner* — Insa Sadio
(74) *Attorney, Agent, or Firm* — F. Chau & Associates, LLC

(57) ABSTRACT

A display device includes a plurality of data lines, a transmission gate element connected to the data lines, wherein the transmission gate supplies precharge voltages and data voltages to the data lines in response to transmission gate signals, and a plurality of pixels connected to the data lines. Each of the pixels includes: a light emitting element; a capacitor; a driving transistor having a control terminal connected to the capacitor, an input terminal, and an output terminal, wherein the driving transistor supplies a driving current to the light emitting element; a first switch, wherein the first switch diode-connects the driving transistor in response to a gate signal and connects one of the data lines to the capacitor; and a second switch, wherein the second switch supplies a reference voltage to the capacitor in response to the gate signal and connects the driving transistor to the light emitting element, wherein the precharge voltage, the data voltage, and the reference voltage are applied to the capacitor, and wherein the capacitor stores a charging voltage based on the applied data voltage and a threshold voltage of the driving transistor.

23 Claims, 7 Drawing Sheets

370

DISPLAY DEVICE AND DRIVING METHOD THEREOF

CROSS-REFERENCE TO RELATED PATENT APPLICATION

This application claims priority to Korean Patent Application No. 10-2005-0011224, filed on Feb. 7, 2005, in the Korean Intellectual Property Office, the disclosure of which is herein incorporated by reference in its entirety.

BACKGROUND OF THE INVENTION

1. Technical Field

The present invention relates generally to a display device and a method of driving the same.

2. Description of the Related Art

Organic light emitting devices (OLEDs) utilize fluorescent organic materials that emit light when excited by an electric current. These devices are an increasingly popular form of flat panel display technology due to their self-emitting properties, low power requirements, wide viewing angle, excellent responsiveness, and compatibility with full-motion video. An active matrix organic light-emitting device having a plurality of pixels arranged in matrix form realizes image display by controlling the luminance of each pixel.

Generally, an OLED has as many organic light emitting elements as the number of pixels displayed, and includes thin film transistors (TFTs) for driving the organic light emitting elements. The silicon semiconductor of a TFT is classified into two types: an amorphous silicon semiconductor (a-Si) type and a polycrystalline silicon (poly-Si) semiconductor type.

The a-Si TFTs are commonly used in the display devices utilizing glass substrates with relatively low melting points. This is because the a-Si semiconductor can be produced at a low film-forming temperature, for example, by a vapor-phase deposition method. However, the a-Si TFTs may be incompatible with the large display devices because of the relatively low field effect mobility of the a-Si TFTs. In addition, when the a-Si TFTs supply current to the organic light-emitting elements continuously, a transition of threshold voltages is generated which deteriorates the TFTs. As a result, the lifetime of the OLEDs with a-SI TFTs is reduced.

To achieve an increase in mobility, a poly-Si film can be used as the semiconductor layer of the TFTs, instead of a-Si. The poly-Si is a promising material for obtaining TFTs with high field-effect mobility, good high-frequency characteristics, and low leakage current. For example, adopting a backplane of low temperature poly-Si can extend the lifetime of the light emitting element. However, damage during the crystallization process using laser annealing technology may cause deviations of the threshold voltages between driving transistors for supplying current to the organic light emitting elements, thereby lowering uniformity of image display.

The pixel circuits that have been proposed to realize the uniform image display over the entire screen by compensating for the deviation between the threshold voltages cannot satisfy the increasing demands for high-density OLEDs, since they have too many TFTs, storage capacitors, and interconnect wiring.

SUMMARY OF THE INVENTION

Exemplary embodiments of the present invention provide a display device and a method of driving the same.

According to an exemplary embodiment of the present invention, a display device includes a plurality of data lines, a transmission gate element connected to the data lines, wherein the transmission gate element supplies precharge voltages and data voltages to the data lines in response to transmission gate signals, and a plurality of pixels connected to the data lines.

Each of the pixels includes a light emitting element, a capacitor, a driving transistor having a control terminal connected to the capacitor, an input terminal, and an output terminal, wherein the driving transistor supplies a driving current to the light emitting element, a first switch, wherein the first switch diode-connects the driving transistor in response to a gate signal and connects one of the data lines to the capacitor, and a second switch, wherein the second switch supplies a reference voltage to the capacitor in response to the gate signal and connects the driving transistor to the light emitting element. The precharge voltage, the data voltage, and the reference voltage are applied to the capacitor, and the capacitor stores a charging voltage based on the applied data voltage and a threshold voltage of the driving transistor.

The first switch may include a first switching transistor that connects the capacitor to the data line in response to the gate signal, and a second switching transistor that connects between the control terminal and the output terminal of the driving transistor.

The second switch may include a third switching transistor that connects the capacitor to the reference voltage in response to the gate signal, and a fourth switching transistor that connects between the output terminal of the driving transistor and the light emitting element.

The gate signal may include a high level voltage that turns on the first and second switching transistors and turns off the third and fourth switching transistors, and a low level voltage that turns off the first and second switching transistors and turns on the third and fourth switching transistors.

The input terminal of the driving transistor may be connected to a driving voltage, and the charging voltage may have a value obtained by deducting an absolute value of the threshold voltage of the driving transistor from the driving voltage.

The precharge voltage may be equal to or larger than a predetermined maximum value of the data voltage, and the reference voltage may be equal to or smaller than a predetermined minimum value of the data voltage.

The first, second, third, and fourth switching transistors and the driving transistor may be poly-Si thin film transistors.

The first switching transistor and the second switching transistor may be P-type thin film transistors, while the third switching transistor and the fourth switching transistor may be N-type thin film transistors.

The light emitting element may include an organic light emitting layer.

The display device may further include a plurality of data driving lines, and a data driver connected to the data driving lines and supplies the precharge voltage and the data voltage to the data driving lines. Here, the data driving lines may be connected to the transmission gate element.

The data driver may supply the precharge voltage and the data voltage to the respective data driving lines in sequence.

The display device may further include first, second, and third transmission gate signal lines that transmit the transmission gate signals to the transmission gate element, and a transmission gate driver that supplies the transmission gate signals to the first, second, and third transmission gate signal lines, wherein the transmission gate element may include a plurality of triplets of first, second, and third transmission gates that are individually connected to the first, second, and third transmission gate signal lines, and the transmission gate driver turns on the triplets of first, second, third transmission gates in sequence after turning them on at the same time.

The first switch may be turned on after the triplets of transmission gates are turned on at the same time, and the second switch may be turned on after the triplets of transmission gates are turned on in sequence.

According to another exemplary embodiment of the present invention, a method of driving a display device, which includes a transmission gate, a capacitor, a light emitting element, a driving transistor having a control terminal connected to the capacitor, a first terminal connected to a driving voltage, and a second terminal. The method includes the steps of (A) applying a precharge voltage and a data voltage to the transmission gate in sequence, (B) connecting between the transmission gate and the capacitor, (C) connecting between the control terminal and the second terminal of the driving transistor, (D) connecting the capacitor to a reference voltage, and (E) connecting between the second terminal of the driving transistor and the light emitting element.

The precharge voltage may be equal to or larger than a predetermined maximum value of the data voltage, and the reference voltage may be equal to or smaller than a predetermined minimum value of the data voltage.

The step (B) may be performed after the precharge voltage is applied to the transmission gate.

The step (D) may include a sub-step of disconnecting between the transmission gate and the capacitor, and the step (E) includes a sub-step of disconnecting the control terminal and the second terminal of the driving transistor.

BRIEF DESCRIPTION OF THE DRAWINGS

The present invention will become more apparent to those of ordinary skill in the art when descriptions of exemplary embodiments thereof are read with reference to the accompanying drawings.

DETAILED DESCRIPTION OF PREFERRED EMBODIMENTS

Figure 1:
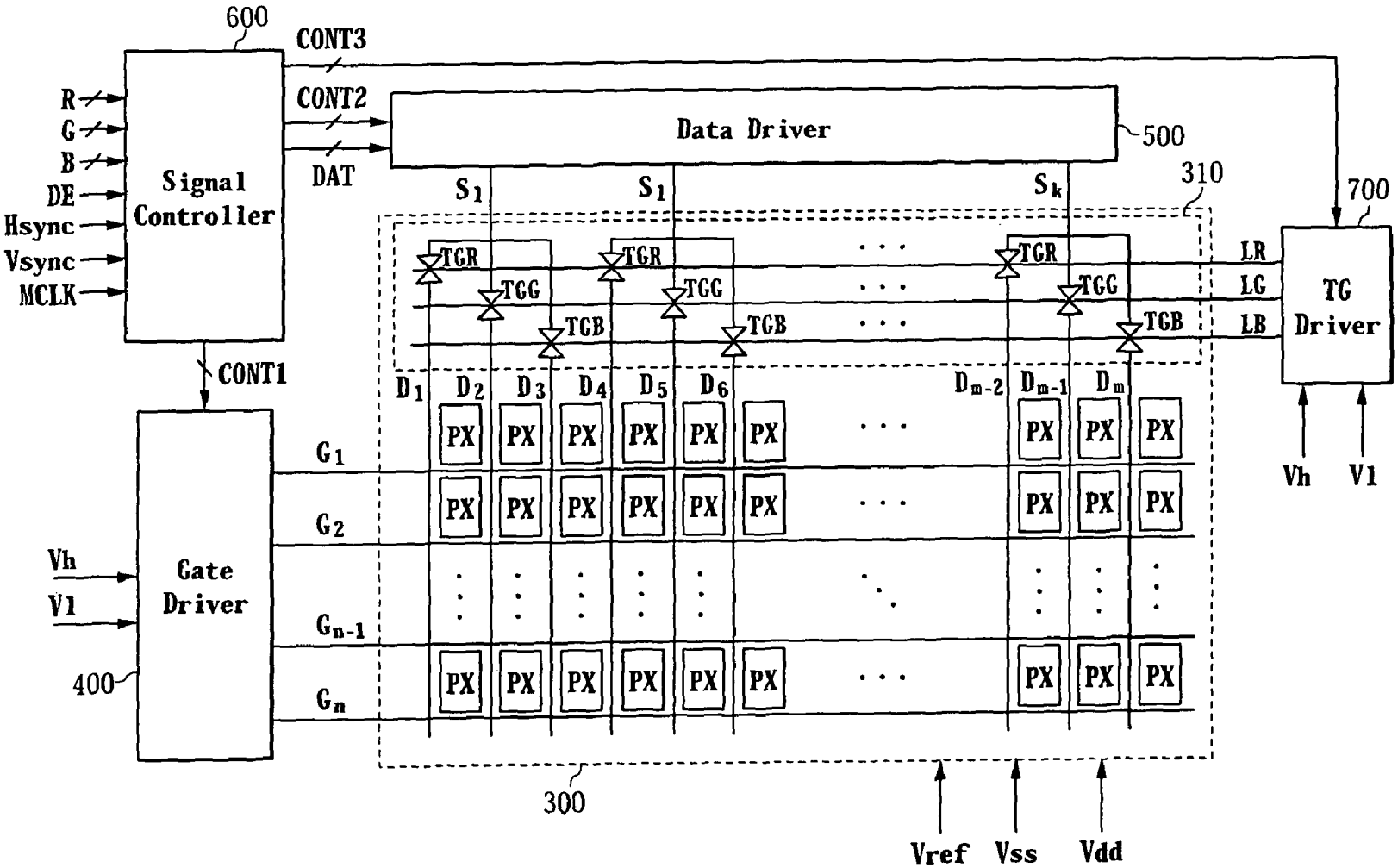
FIG. 1 is a block diagram of an organic light emitting device according to an exemplary embodiment of the present invention.

Hereinafter, exemplary embodiments of the present invention will be described in detail with reference to the accompanying drawings.

In the drawings, the size and relative sizes of the layers, films, and regions may be exaggerated for clarity. Like reference numerals refer to like elements throughout the description of the figures. When an element such as a layer, film, region, or substrate is referred to as being "on" another element, it can be directly on the other element or intervening elements may also be present.

Hereinafter, an organic light emitting device according to a preferred embodiment of the present invention will be described with reference to FIG. 1 through FIG. 6.

Figure 2:
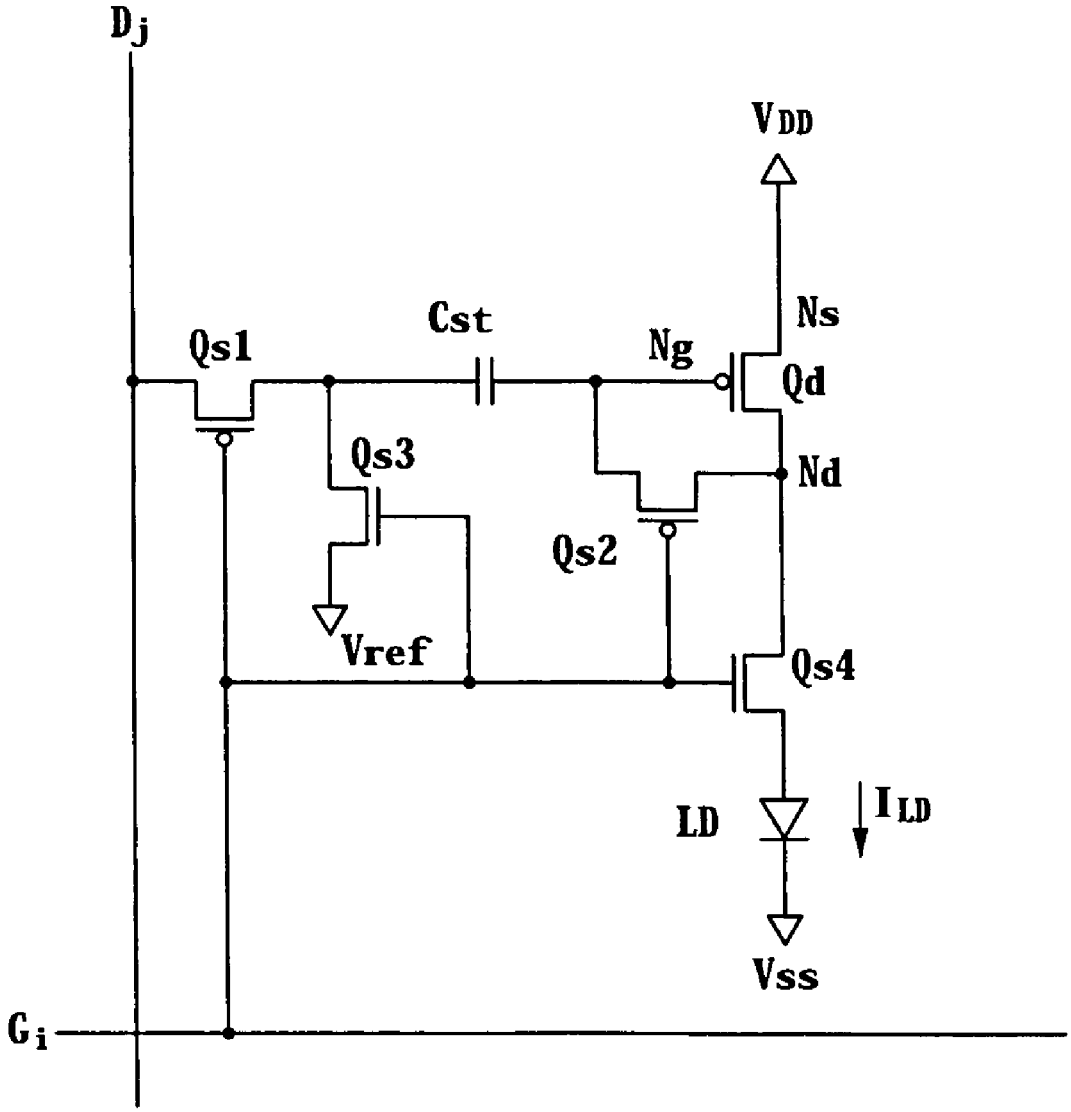
FIG. 2 is a circuit diagram of a pixel of an organic light emitting device according to an exemplary embodiment of the present invention.
Figure 3:
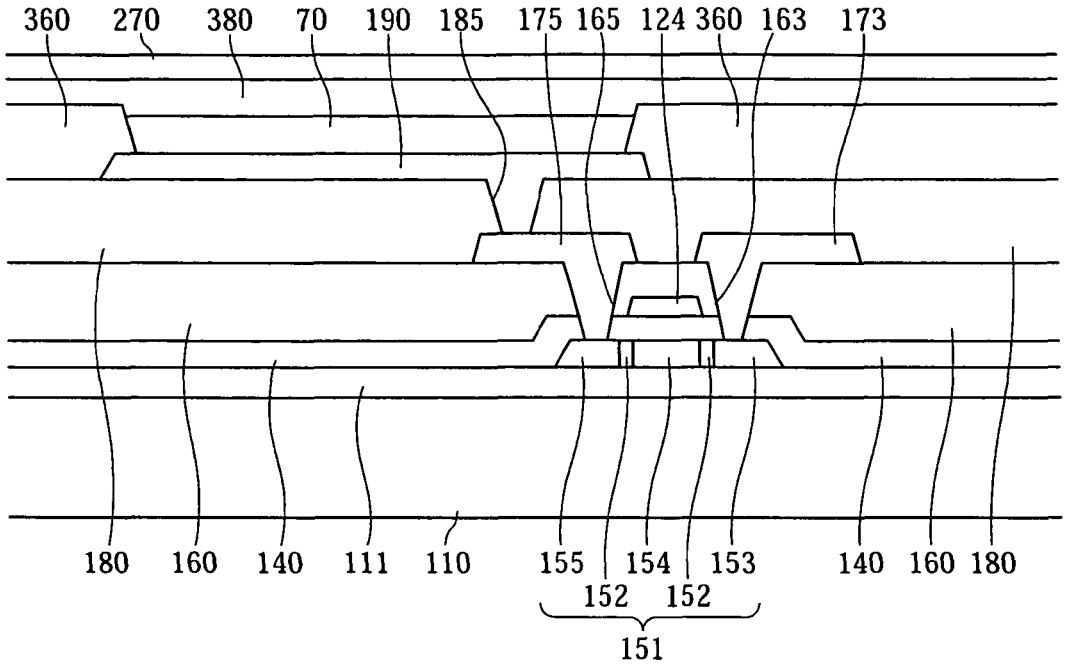
FIG. 3 is a cross-sectional view showing vertical schemes of a switching transistor and an organic light emitting element employed in an organic light emitting device according to an exemplary embodiment of the present invention.
Figure 4:
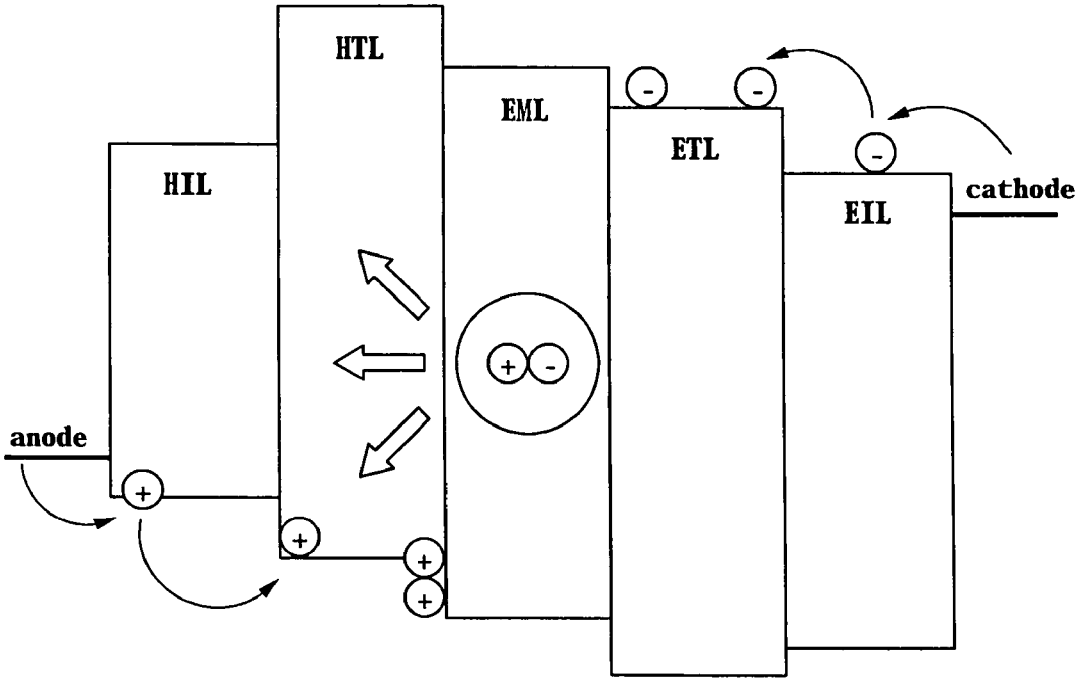
FIG. 4 is a schematic view of an organic light emitting element employed in an organic light emitting device according to an exemplary embodiment of the present invention.

FIG. 1 is a block diagram of an organic light emitting device according to an exemplary embodiment of the present invention. FIG. 2 is a circuit diagram of a pixel of an organic light emitting device according to an embodiment of the present invention. FIG. 3 is a cross-sectional view showing vertical schemes of a switching transistor and an organic light emitting element employed in an organic light emitting device according to an exemplary embodiment of the present invention. FIG. 4 is a schematic view of an organic light emitting element employed in an organic light emitting device according to an exemplary embodiment of the present invention.

Referring to FIG. 1, an organic light emitting device according to an exemplary embodiment of the present invention comprises a display panel 300, a gate driver 400 that is connected to the display panel 300, a data driver 500, a transmission gate (TG) driver 700, and a signal controller 600 for controlling the above elements.

The display panel 300 includes: a plurality of signal lines $G_1$-$G_n$, $D_1$-$D_m$, $S_1$-$S_k$, LR, LG, and LB; a plurality of pixels PX that are connected to the signal lines $G_1$-$G_n$ and $D_1$-$D_m$ and are arranged substantially in a matrix form; and a transmission gate element 310 that is connected to the signal lines $D_1$-$D_m$, LR, LG, and LB.

The signal lines $G_1$-$G_n$, $D_1$-$D_m$, $S_1$-$S_k$, LR, LG, and LB include a plurality of gate lines $G_1$-$G_n$ for transmitting gate signals (also referred to as "scanning signals"), a plurality of data lines $D_1$-$D_m$ and a plurality of data driving lines $S_1$-$S_k$ for transmitting data signals, and three transmission gate lines LR, LG, and LB for transmitting transmission gate signals. The gate lines $G_1$-$G_n$ and the transmission gate lines LR, LG, and LB extend substantially in a row direction and are substantially parallel to each other. The data lines $D_1$-$D_m$ and the data driving lines $S_1$-$S_k$ extend substantially in a column direction and are substantially parallel to each other. The data lines $D_1$-$D_m$ are connected to the data driving lines $S_1$-$S_k$ via the transmission gate element 310. For example, each data driving line is connected to a triplet of data lines. Accordingly, $m=3\times k$.

The transmission gate element 310 includes a plurality of triplets of transmission gates TGR, TGG, and TGB. Control terminals of the transmission gates TGR are connected to the transmission gate line LR, output terminals of the transmission gates TGR are connected to the data lines $D_1$, $D_4$, . . . , $D_{m-2}$ in sequence, and input terminals of the transmission gates TGR are connected to the data driving lines $S_1$-$S_k$ in sequence. Control terminals of the transmission gates TGG are connected to the transmission gate line LG, output terminals of the transmission gates TGG are connected to the data lines $D_2$, $D_5$, . . . , $D_{m-1}$ in sequence, and input terminals of the transmission gates TGG are connected to the data driving lines $S_1$-$S_k$ in sequence. Control terminals of the transmission gates TGB are connected to the transmission gate line LB, output terminals of the transmission gates TGB are connected to the data lines $D_3$, $D_6$, . . . , $D_m$ in sequence, and input terminals of the transmission gates TGB are connected to the data driving lines $S_1$-$S_k$ in sequence. For example, three input terminals of each triplet are connected to one of the data driving lines $S_1$-$S_k$, while being connected to each other. The transmission gates TGR, TGG, and TGB are turned on in sequence in response to the transmission signals from the transmission gate driver 700, thereby transmitting the data voltages, which are applied from the data driver 500, to the data lines $D_1$-$D_m$.

FIG. 2 is a circuit diagram of a pixel of an organic light emitting device according to an exemplary embodiment of the present invention. Referring to FIG. 2, each pixel PX includes an organic light emitting element (OLED), a driving transistor $Q_D$, a capacitor $C_{ST}$, and four switching transistors $Q_{S1}$, $Q_{S2}$, $Q_{S3}$, and $Q_{S4}$.

The driving transistor $Q_D$ includes three terminals: a gate terminal Ng connected to the capacitor $C_{ST}$; a drain terminal nd connected to the switching transistor $Q_{S4}$; and a source terminal connected to a driving voltage $V_{DD}$. The capacitor CST is connected to the driving transistor $Q_D$ and between the switching transistors $Q_{S1}$ and $Q_{S3}$. An anode and a cathode of the organic light emitting element OLED are individually connected to the switching transistor $Q_{S4}$ and a common voltage $V_{SS}$.

The luminance of light emitted from the organic light emitting element OLED varies depending on the intensity of a current $I_{OLED}$ supplied from the driving transistor $Q_D$, and the intensity of the current $I_{OLED}$ is largely dependent upon the intensity of a voltage between the gate terminal Ng and the source terminal ns of the driving transistor $Q_D$.

The switching transistors $Q_{S1}$, $Q_{S2}$, $Q_{S3}$, and $Q_{S4}$ operate in response to the gate signals. The switching transistor $Q_{S3}$ is connected between a data voltage $V_{data}$ and the capacitor CST, the switching transistor $Q_{S2}$ is connected between the gate terminal Ng and the drain terminal nd of the driving transistor $Q_D$, the switching transistor $Q_{S3}$ is connected between a reference voltage $V_{ref}$ and the capacitor CST, and the switching transistor $Q_{S4}$ is connected between the drain terminal nd of the driving transistor $Q_D$ and the organic light emitting element OLED.

In an exemplary embodiment of the present invention, the driving transistor $Q_D$ and the switching transistors $Q_{S1}$ and $Q_{S2}$ are P-type poly-Si TFTs, while the switching transistors $Q_{S3}$ and $Q_{S4}$ are N-type poly-Si TFTs. However, the switching transistors $Q_{S1}$ and $Q_{S2}$ may be a-Si TFTs. It will be understood that their channel structures can have various configurations.

The switching transistor $Q_{S4}$ and the organic light emitting element OLED, in accordance with an exemplary embodiment of the present invention, are configured as described below.

FIG. 3 is a cross-sectional view showing vertical schemes of a switching transistor and an organic light emitting element employed in an organic light emitting device according to an exemplary embodiment of the present invention. Referring to FIG. 3, a blocking film 111 that may comprise silicon oxide ($SiO_2$) or silicon nitride ($SiN_x$) is formed on a transparent insulating substrate 110. Although not shown as such in FIG. 3, the blocking film 111 may be configured as a multi-layered structure.

A semiconductor film 150, comprising poly-Si or the like, is formed on a partial portion of the blocking film 111. The semiconductor film 150 includes an extrinsic region with conductive impurities, an intrinsic region with little conductive impurity, a highly doped region, and a lightly doped region 152.

A channel region 154 is formed in the intrinsic region, and a source region 153 and a drain region 155 are formed in highly doped region. The source region 153 and the drain region 155 are disposed opposite to each other, centering on the channel region 154. The lightly doped region 152 is formed between the source region 153 and the channel region 154 and between the drain region 155 and the channel region 154. The lightly doped region 152 may be formed more narrowly than the other regions.

For example, an N-type impurity, such as boron (B), gallium (Ga), phosphorus (P), arsenic (As), or the like, can be used as the conductive impurity. The lightly doped region 152 prevents leakage current and electric field punch-through from occurring in the TFT. The lightly doped region 152 may be substituted with an offset region having no impurities. In an exemplary embodiment of the present invention, the lightly doped region 152 may be omitted if the doped impurities are P-type.

A gate insulating layer 140 made of silicon nitride (SiNx) or silicon oxide ($SiO_2$), is formed on the semiconductor 150.

A gate electrode 124 is formed on a partial portion of the gate insulating layer 140. The gate electrode 124 is overlapped with the channel region 154 of the semiconductor 150 underlying the gate insulating layer 140. The gate electrode 124 may comprise a single layer of an aluminum-(Al) containing metal such as Al or an Al alloy, a silver-(Ag) containing metal such as Ag or a Ag alloy, a copper-(Cu) containing metal such as Cu or a Cu alloy, a molybdenum-(Mo) containing metal such as Mo or a Mo alloy, chromium (Cr), titanium (Ti), or tantalum (Ta), or other suitable material. However, the gate electrode 124 may be configured as a multi-layered structure in which two or more conductive layers (not shown), which may have different physical properties, may be included.

The lateral sides of the gate electrode 124 preferably slope to the surface of the substrate 110 for smooth connection between the gate electrode 124 and an overlying layer.

A first interlayer insulating layer 801 is formed on the gate insulating layer 140 and the gate electrode 124. The first interlayer insulating layer 801 may comprise an inorganic material such as $SiN_x$, a photosensitive organic material having a good planarization property, and/or a low dielectric insulator such as a-Si:C:O, a-Si:O:F, etc., which may be formed by plasma enhanced chemical vapor deposition (PECVD).

A pair of contact holes 183 and 185 are formed in the first interlayer insulating layer 801 and the gate insulating layer 140, and the source region 153 and the drain region 155 are individually exposed through the contact holes 183 and 185.

A source electrode 173 and a drain electrode 175 are formed on the first interlayer insulating layer 801. The source electrode 173 and the drain electrode 175 are placed opposite to each other, centering on the gate electrode 124. The source electrode 173 is connected to the source region 153 through the contact hole 183, and the drain electrode 175 is connected to the drain region 155 through the contact hole 185.

In an exemplary embodiment of the present invention, the gate electrode 124, the source electrode 173, the drain electrode 175, and the semiconductor 150 form the switching transistor $Q_{S4}$.

The source electrode 173 and the drain electrode 175 are preferably comprise a refractory metal such as Mo, Cr, Ta, or Ti, or alloys thereof. Similarly to the gate electrode 124, the source electrode 173 and the drain electrode 175 may be configured as multi-layered structures, for example, including a conductive layer with low resistivity and another conductive layer with a good contact property.

The lateral sides of the source electrode 173 and the drain electrode 175 preferably slope to the surface of the substrate 110.

A second interlayer insulating layer 802, which may comprise the same material as the first interlayer insulating layer 801, is formed on the source electrode 173 and the drain electrode 175. The second interlayer insulating layer 802 is provided with a contact hole 186, through which the drain electrode 175 is exposed.

A pixel electrode 190 is formed on the second interlayer insulating layer 802, and is physically and electrically connected to the drain electrode 175 through the contact hole 186. The pixel electrode 190 may comprise a transparent conductor such as indium tin oxide (ITO) or indium zinc oxide (IZO), or a good reflective material such as Al or Ag, or alloys thereof.

A barrier 803 made of an organic insulator or an inorganic insulator is formed on the second interlayer insulating layer 802 to separate organic light-emitting cells from one another. The barrier 803 surrounds the border of the pixel electrode 190 to define a region that will be filled with an organic material. An organic light emitting layer 70 is formed on a partial portion of the pixel electrode 190, which is surrounded with the barrier 803.

FIG. 4 is a schematic view of an organic light emitting element employed in an organic light emitting device according to an exemplary embodiment of the present invention. As shown in FIG. 4, the organic light emitting layer 70 is configured as a multi-layered structure including an emitting layer EML, an electron transport layer ETL, and a hole transport layer HTL. The electron transport layer ETL and the hole transport layer HTL are provided to improve light emitting efficiency by inducing a good balance between holes and electrons. In addition to the above-described layers, a separate electron injecting layer EIL and a hole injecting layer HIL may be further included in the organic light emitting layer 70.

A buffer layer 804 may be formed on the barrier 803 and the organic light emitting layer 70. The buffer layer 804 may be omitted.

A common electrode 270 for receiving the common voltage $V_{ss}$ is formed on the buffer layer 804. The common electrode 270 may comprise a transparent conductor such as ITO or IZO. In the case that the pixel electrode 190 is made of a transparent material, the common electrode 270 may be made of an opaque metal such as a calcium-(Ca) containing metal, a barium-(Ba) containing metal, or an aluminum-(Al) containing metal.

Generally, a top emission type of organic light emitting device, where light is emitted from the upper side of the organic light emitting layer, employs the pixel electrode 190 comprising an opaque material and the common electrode 270 comprising a transparent material, whereas a bottom emission type of organic light emitting device, where light is emitted from the lower side of the organic light emitting layer, employs the pixel electrode 190 comprising a transparent material and the common electrode 270 comprising an opaque material.

The pixel electrode 190, the organic light emitting layer 70, and the common electrode 270 form the organic light emitting element OLED shown in FIG. 2. For example, the pixel electrode 190 serves as the anode of the OLED and the common electrode 270 serves as the cathode of the OLED. Conversely, the pixel electrode 190 may be the cathode and the common electrode 270 may be the anode.

Each organic light emitting element OLED uniquely exhibits one of the three primary colors (red, green, and blue colors) depending on an organic material used to form the light-emitting layer EML, so that the spatial sum of the primary colors is recognized as a desired color. Hereinafter, a pixel with an organic light emitting element OLED emitting red light will be referred to as a red pixel, a pixel with an organic light emitting element OLED emitting green light as a green pixel, and a pixel with an organic light emitting element OLED emitting blue light as a blue pixel. The red pixels are individually connected to the data lines $D_1$, $D_4$, . . . , $D_{m-2}$, the green pixels are individually connected to the data lines $D_2$, $D_5$, . . . , $D_{m-1}$, and the blue pixels are individually connected to the data lines $D_3$, $D_6$, . . . , $D_m$.

An auxiliary electrode (not shown) comprising a low resistivity metal may be formed between the common electrode 270 and the buffer layer 804, or on the common electrode 270, to supplement conductivity of the common electrode 270.

Referring to FIG. 1, the gate driver 400, which is connected to the gate lines $G_1$-$G_n$ of the display panel 300, supplies gate signals $V_{g1}$-$V_{gn}$, each consisting of combinations of a high level voltage $V_h$ and a low level voltage $V_1$, to the gate lines $G_1$-$G_n$. The gate driver 400 may consist of a plurality of integrated circuits. The gate signal of the high level voltage $V_h$ turns off the switching transistors $Q_{S1}$ and $Q_{S2}$, while turning on the switching transistors $Q_{S3}$ and $Q_{S4}$. The gate signal of the low level voltage $V_1$ turns on the switching transistors $Q_{S1}$ and $Q_{S2}$, while turning off the switching transistors $Q_{S3}$ and $Q_{S4}$.

The transmission gate driver 700, which is connected to the transmission gate lines LR, LG, and LB, supplies the transmission gate signals VR, VG, and VB to the transmission gates LGR, LGB, and LGB of the transmission gate element 310 via the transmission gate lines LR, LG, and LB. Each of the transmission gate signals VR, VG, and VB consists of combinations of the high level voltage $V_h$ and the low level voltage $V_1$. The transmission gate signal of the high level voltage $V_h$ turns on the transmission gate, and the transmission gate signal of the low level voltage $V_1$ turns off the transmission gate.

The data driver 500, which is connected to the data driving lines $S_1$-$S_k$ of the display panel 300, supplies the data voltages $V_{data}$ for desired image information to the transmission gate element 310 via the data driving lines $S_1$-$S_k$. The data driver 500 may consist of a plurality of integrated circuits. In this exemplary embodiment of the present invention, it is possible to reduce the dimension of a pad portion (not shown) because the number of data driving lines is less than the number of data lines. In this case, the density of the display panel 300 becomes higher due to the reduced pad portion.

The signal controller 600 controls the operations of the gate driver 400, the data driver 500, and the transmission gate driver 700.

The gate driver 400 or the data drivers 500 may be directly mounted on the display panel 300, having the shape of IC chips, or may be mounted on flexible printed circuit (FPC) films (not shown) attached to the display panel 300, having the shape of tape carrier packages (TCPs). The gate driver 400 or the data drivers 500 may be integrated into the substrate 110 of the display panel 300. The transmission gate driver 700 is preferably integrated into the substrate 110 of the display panel 300. The data driver 500 and the signal controller 600 may be integrated into an IC chip by one-chip technology, and the gate driver 400 and the transmission gate driver 700 may also be integrated into the same IC chip.

Hereinafter, the display operation of the organic light emitting device according to an exemplary embodiment of the present invention is described in detail with reference to FIG. 1, FIG. 5, FIG. 6A, and FIG. 6B.

Figure 5:
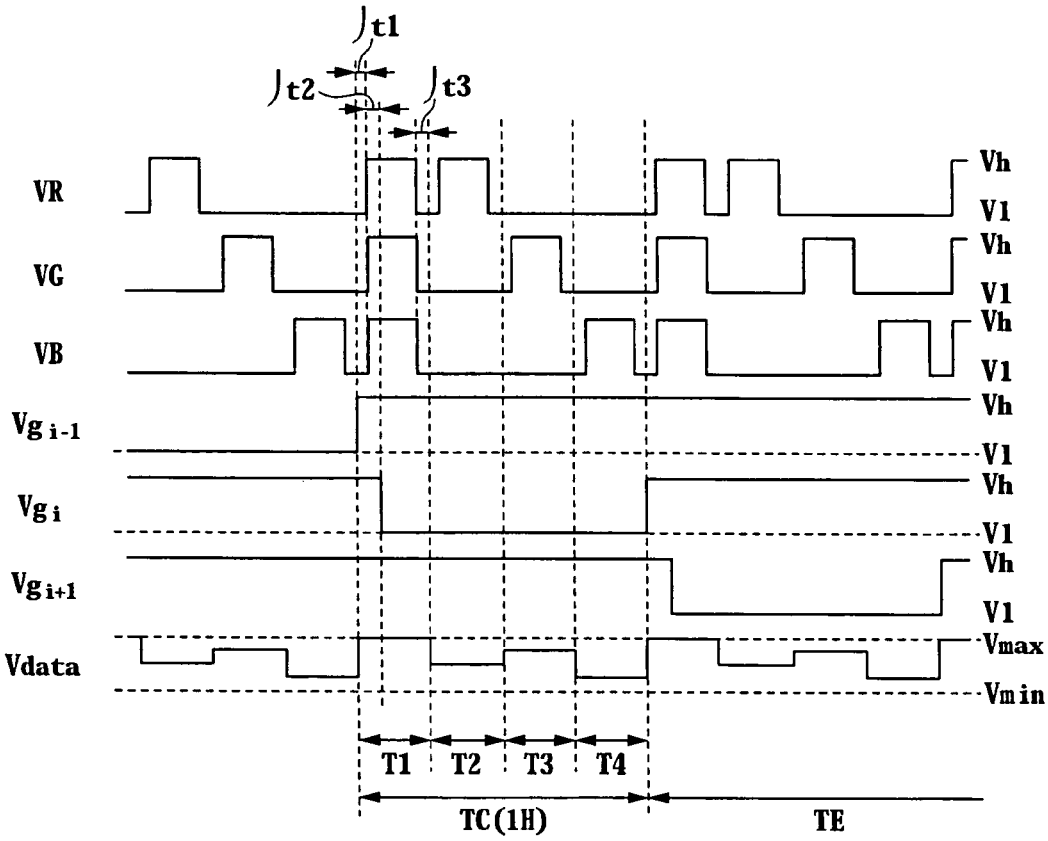
FIG. 5 is a timing chart showing driving signals of an organic light emitting device according to an exemplary embodiment of the present invention.
Figure 6A:
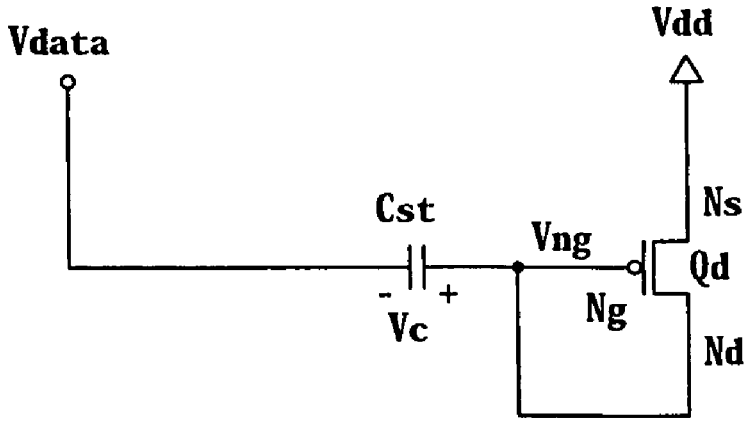
FIG. 6A is a circuit diagram showing the state of a pixel during the charging period.
Figure 6B:
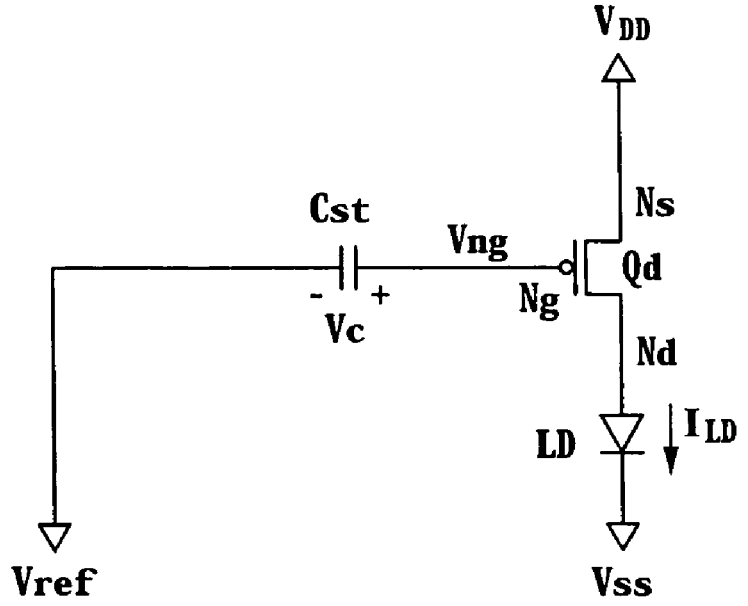
FIG. 6B is a circuit diagram showing the state of a pixel during the light emission period.

FIG. 5 is a timing chart showing driving signals of an organic light emitting device according to an exemplary embodiment of the present invention. FIG. 6A is a circuit diagram showing the state of a pixel during the charging period. FIG. 6B is a circuit diagram showing the state of a pixel during the light emission period.

Referring to FIG. 1, the signal controller 600 receives image signals R, G, and B and control signals for controlling the display thereof, such as a vertical synchronizing signal $V_{sync}$, a horizontal synchronizing signal $H_{sync}$, a main clock signal MCLK, a data enable signal DE, etc., from an external graphics controller (not shown). On the basis of the image signals R, G, and B and the control signals, the signal controller 600 processes the image signals R, G, and B suitably for the operation conditions of the display panel 300, and generates gate control signals CONT1, data control signals CONT2, and transmission gate control signals CONT3. Then, the signal controller 600 supplies the gate control signals CONT1, the data control signals CONT2 and the processed image data DAT, and the transmission gate control signals CONT3 to the gate driver 400, the data driver 500, and the transmission gate driver 700, respectively.

The gate control signals CONT1 include a vertical synchronizing start signal STV for informing of the beginning of the output of the gate-on voltages $V_{g1}$-$V_{gn}$, and at least one clock signal for controlling the output of the high level voltage $V_h$ and the low level voltage $V_l$.

The data control signals CONT2 include a horizontal synchronizing start signal STH for informing of the beginning of data transmission for a row of pixels PX, a load signal LOAD for instructing to apply the corresponding data voltages to the respective data driving lines $S_1$-$S_k$, and a data clock signal HCLK.

The transmission gate control signals CONT3 include a vertical synchronizing start signal STV, and at least one clock signal for controlling the output of the high level voltage $V_h$ and the low level voltage $V_l$.

In response to the data control signals CONT2 that are supplied from the signal controller 600, the data driver 500 shifts the image data DAT for a row of pixels, for example, for an i-th row, which are applied from the signal controller 600, and then applies a precharge voltage $V_{max}$ and R, G, and B data voltages $V_{data}$ corresponding to the respective image data DAT, to the corresponding data driving lines $S_1$-$S_k$ in sequence.

A charging period TC or a unit of the horizontal period (denoted by "1H" and which is equal to one period of the horizontal synchronizing signal $H_{sync}$ and the data enable signal DE) begins with the application of the precharge voltage $V_{max}$. The charging period TC is subdivided into four periods TC1 to TC4 that are continued in sequence. In the first period TC1, the data driver 500 applies the precharge voltage $V_{max}$ to the data driving lines $S_1$-$S_k$. Next, in the periods TC2, TC3, and TC4, the data driver 500 applies the R, G, and B data voltages $V_{data}$ to the data driving lines $S_1$-$S_k$. In an exemplary embodiment of the present invention, the precharge voltage $V_{max}$ is equal to or larger than the maximum data voltage $V_{data}$.

After a predetermined time Δt1 from the beginning of the first period TC1, the transmission gate driver 700 changes the transmission gate signals VR, VG, and VB of the low level voltages $V_1$ into the high level voltages $V_h$ in response to the transmission gate signals CONT3. The transmission gate signals VR, VG, and VB of the high voltages $V_h$ are then individually applied to the corresponding transmission gates TGR, TGG, and TGB of the transmission gate element 310 through the transmission gate lines LR, LB, and LG, thereby turning on the transmission gates TGR, TGG, and TGB. As a result, all data lines $D_1$-$G_m$ are supplied with the precharge voltage $V_{max}$.

In the first period TC1, after a predetermined time Δt2 from a point of time when the transmission gate signals VR, VG, and VB become the high level voltages $V_h$, the gate driver 400 changes the gate signal $V_{gi}$ of the high level voltage $V_h$ into the low level voltage $V_l$ in response to the gate control signal CONT1. The gate signal $V_{gi}$ of the low level voltage $V_l$ is the applied to four switching transistors $Q_{S1}$ to $Q_{S2}$ through the gate line $G_i$, thereby turning on the switching transistors $Q_{S1}$ and $Q_{S2}$ while turning off the switching transistors QS3 and $Q_{S4}$. From that point, the gate driver 400 maintains the gate signal $V_{gi}$ as the low level voltage $V_l$ during the remaining charging period TC.

The state of a pixel during the first period TC1 is shown in the circuit of FIG. 6A. In this period, the precharge voltage $V_{max}$ is applied to the capacitor CST, and a voltage $V_{gs}$ between the gate terminal Ng and the source terminal ns of the driving transistor $Q_D$ is equalized to a threshold voltage $V_{th}$ of the driving transistor $Q_D$ since the driving transistor $Q_D$ is a diode-connected transistor. A gate terminal voltage $V_{ng}$ of the driving transistor $Q_D$ and a charging voltage $V_c$ of the capacitor CST can be derived from the following equations:

$$V_{ng}=V_{DD}|V_{th}| \quad \text{<Equation 1>}$$

$$V_c=V_{DD}|V_{th}|-V_{max}. \quad \text{<Equation 2>}$$

When a predetermined time Δt3 has passed after all transmission gate signals VR, VG, and VB become the low level voltages $V_l$, the data driver 500 supplies the red data voltage $V_{data}$ to the respective data driving lines $S_1$-$S_k$ and the second period TC2 begins. After a predetermined time Δt1 from the beginning of the second period TC2, the transmission gate driver 700 changes the transmission gate signal VR of the low level voltage $V_l$ into the high level voltage $V_h$, so that the red data voltage $V_{data}$ applied to the respective data driving lines $S_1$-$S_k$ is applied to the corresponding data lines $D_1$, $D_4$, . . . , $D_{m-2}$. Since the gate signal $V_{gi}$ is maintained as the low level voltage $V_l$ in this period, the on-states of the switching transistors $Q_{S1}$ and $Q_{S2}$ and the off-states of the switching transistors $Q_{S3}$ and $Q_{S4}$ are still maintained.

In this case, the state of a red pixel can be expressed as the circuit of FIG. 6A. When the red data voltage $V_{data}$ is applied to the capacitor CST, the gate terminal voltage $V_{ng}$ becomes smaller than that of Equation 1 since the red data voltage $V_{data}$ is smaller than the precharge voltage $V_{max}$. At this time, the driving transistor $Q_D$ is turned on, so that a voltage between the gate terminal Ng and the source terminal ns of the driving transistor $Q_D$ becomes the threshold voltage $V_{th}$ of the driving transistor $Q_D$. As a result, the gate terminal voltage $V_{ng}$ regains the value defined by Equation 1. At this point, the capacitor $C_{ST}$ is charged again with the charging voltage $V_c$ that satisfies the following equation:

$$V_c=V_{DD}|V_{th}|-V_{data}. \quad \text{<Equation 3>}$$

The above-mentioned equation proves that the capacitor $C_{ST}$ is charged with the charging voltage $V_c$ based on the data voltage $V_{data}$ and the threshold voltage $V_{th}$ of the driving transistor $Q_D$.

The transmission gate driver 700 changes the transmission gate signal VR of the high level voltage $V_h$ into the low level voltage $V_l$, thereby cutting off the transmission gate TGR. Accordingly, the capacitor $C_{ST}$ becomes to be in a floating state and the charging voltage $V_c$ is maintained until the charging period TC of the next frame period begins.

The third and fourth periods TC3 and TC4 progress in the same manner as the second period TC2, excepting that the third period TC3 deals with green pixels in the corresponding row and the fourth period TC4 deals with blue pixels, in the same row. Therefore, the gate terminal voltages $V_{ng}$ and the charging voltages Vc of the green and blue pixels obtain the voltage values satisfying Equation 1 and Equation 3.

When all pixels in a row are charged with the corresponding data voltages $V_{data}$ during the charging period TC, the gate driver 400 changes the gate signal $V_{gi}$ of the low level voltage $V_l$ into the high level voltage $V_h$. The gate signal $V_{gi}$ of the high level voltage $V_h$ is then applied to the switching transistors $Q_{S1}$ to $Q_{S4}$ via the gate signal line $G_i$, thereby turning off the switching transistors $Q_{S1}$ and $Q_{S2}$ while turning on the switching transistors $Q_{S3}$ and $Q_{S4}$.

At this point, the light emission period TE begins. The state of a pixel during the light emission is shown in the circuit of FIG. 6B.

Referring to FIG. 6B, in this period, the reference voltage $V_{ref}$ is applied to the capacitor $C_{ST}$ and the organic light emitting element OLED is connected to the driving transistor $Q_D$.

Since the capacitor $C_{ST}$, which is in the floating state, is supplied with the reference voltage $V_{ref}$ and no current flows along the gate terminal Ng of the driving transistor $Q_D$, the gate terminal voltage $V_{ng}$ changes to a voltage satisfying the following equation:

$$V_{ng} = V_C + V_{ref} \qquad \text{<Equation 4>}$$
$$= V_{DD} - |V_{th}| - V_{data} + V_{ref}.$$

The changed value of the gate terminal voltage $V_{ng}$ is maintained in the remaining light emission period TE.

The driving transistor $Q_D$ supplies an output current $I_{OLED}$, which is controlled by the voltage $V_{gs}$ between the gate terminal Ng and the source terminal ns, to the organic light emitting element OLED through the drain terminal nd. The intensity of the output current $I_{OLED}$ determines the amount of light emitted from the organic light emitting element OLED. Accordingly, by controlling the intensity of the output current $I_{OLED}$ to be applied to the organic light emitting element OLED, desired images can be obtained. The output current $I_{OLED}$ is calculated by the following equation:

$$I_{OLED} = 0.5 \times k \times (|V_{gs}| - |V_{th}|)^2 \qquad \text{<Equation 5>}$$
$$= 0.5 \times k \times (V_{DD} - V_{ng} - |V_{th}|)^2$$
$$= 0.5 \times k \times [V_{DD} - (V_{DD} - |V_{th}| - V_{data} + V_{ref}) - |V_{th}|]^2$$
$$= 0.5 \times k \times (V_{data} - V_{ref})^2$$

where k is a constant based on characteristics of the TFT. The constant K is defined by $\mu \cdot C_{SINx} \cdot W/L$ where $\mu$ is a degree of the field effect mobility, $C_{SINx}$ is a capacitance of an insulating layer, W is a channel width of the TFT, and L is a channel length of the TFT.

Equation 5 shows that the output current $I_{OLED}$ in the light emission period TE is determined only based on the data voltage $V_{data}$ and the reference voltage $V_{ref}$. The threshold voltage $V_{th}$ of the driving transistor $Q_D$ has no effect on the output current $I_{OLED}$. Accordingly, even if the threshold voltages $V_{th}$ of the respective driving transistors $Q_D$ have different values, uniform image display is possible. In an exemplary embodiment of the present invention, the reference voltage $V_{ref}$ is set up not to exceed a minimum value $V_{min}$ of the data voltage $V_{data}$.

The light emission period TE continues until the charging period TC for the pixels of the i-th row starts again in the next frame. The i+1-th row experiences the charging period TC and the light emission period TE that are equal to the previously mentioned periods TC and TE. The charging period TC for the i+1-th row begins with completion of the charging period for the i-th row. In this way, all pixels in a matrix experience the above-described successive periods TC1 to TC4, and TE, thereby realizing desired image display.

The length of each period and three time intervals Δt1, Δt2, and Δt3 may be controlled as occasion demands. However, it is preferable to turn on the transmission gates TGR, TGG, and TGB after the precharge voltage $V_{max}$ and the data voltage $V_{data}$, applied to the data driving lines $S_1$-$S_k$ from the data driver 500, are stabilized, and to change the data voltage $V_{data}$ after the transmission gates TGR, TGG, and TGB are turned off.

The results of a simulation for deviations of the threshold voltages $V_{th}$ of the driving transistors $Q_D$ employed in the organic light emitting device are discussed below with reference to FIG. 7.

Figure 7:
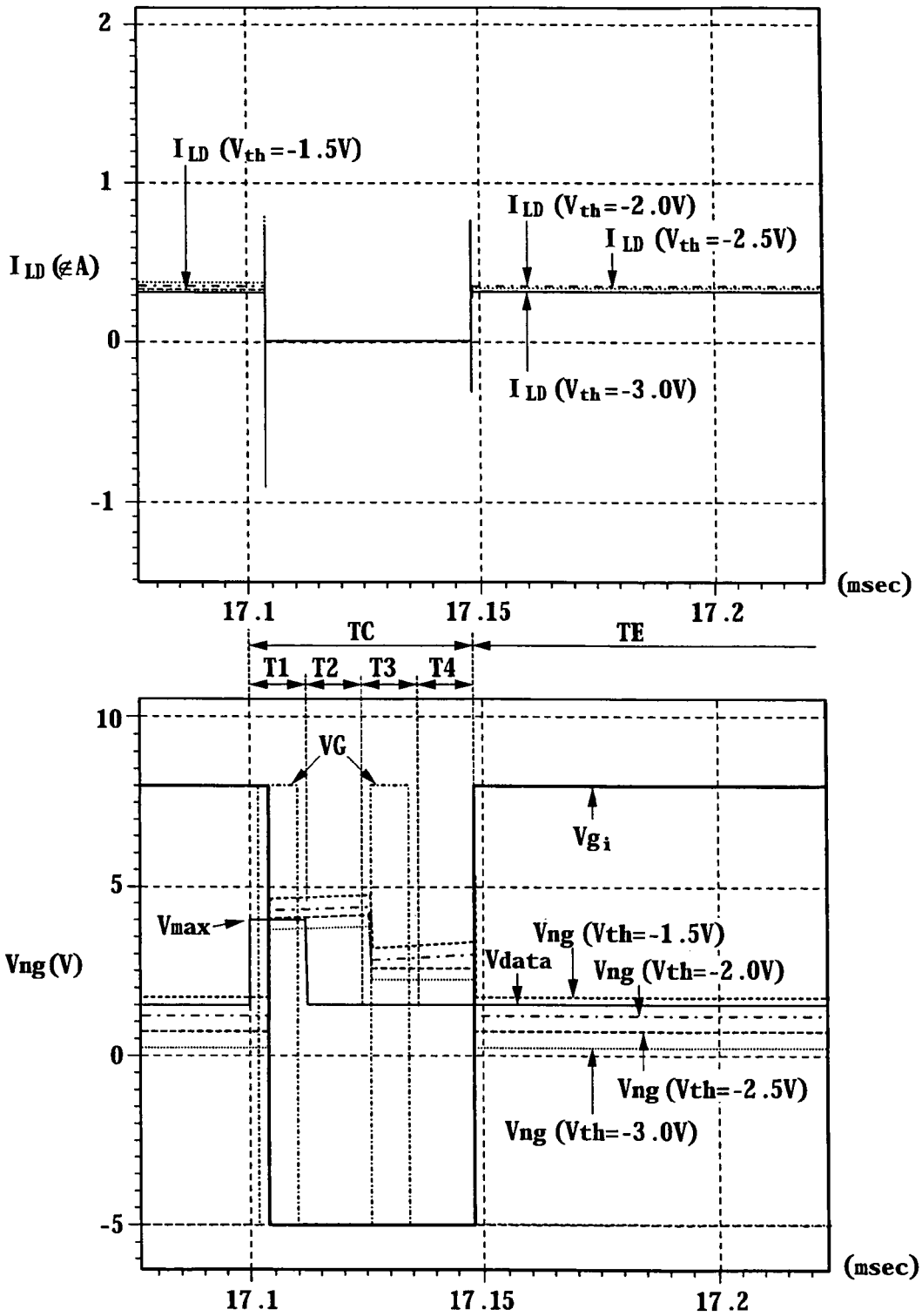
FIG. 7 shows waveforms of gate terminal voltages and output currents in response to different threshold voltages and driving voltages in an organic light emitting device according to an exemplary embodiment of the present invention.

FIG. 7 shows waveforms of the gate terminal voltages $V_{ng}$ and the output currents $I_{OLED}$ when the threshold voltages $V_{th}$ of −1.5V, −2.0V, −2.5V, and −3.0V are given. The simulation utilized a simulation program with integrated circuit emphasis (SPICE). Given, for example, that the high level voltage $V_h$ is 8V, the low level voltage $V_l$ is −5V, the precharge voltage is 4V, and the data voltage is 1.5V, different voltages by about 0.5V were individually applied to the gate terminal Ng in each case. However, the output currents $I_{OLED}$ were substantially uniform in all cases, as shown in FIG. 7.

The simulation results prove that the deviations of the threshold voltages $V_{th}$ of the driving transistors $Q_D$ employed in the organic light emitting device according to exemplary embodiments of the present invention can be compensated.

As described above, each pixel includes four switching transistors, a driving transistor, an organic light emitting element, and a capacitor. In the exemplary embodiments of the present invention, the deviation of the threshold voltages occurring between the driving transistors is compensated by the capacitor charging voltage that is dependent on the data voltage and the threshold voltage of the driving transistor to compensate, and the uniform image display is realized.

In addition, by adopting the three transmission gate driving technology, the number of data driving lines becomes only a third of the number of data lines. The dimension of the pad portion for connection with the data driver is reduced, and the density of the display device panel 300 becomes higher.

Although the exemplary embodiments of the present invention have been described with reference to the accompanying drawings for the purpose of illustration, it is to be understood that the inventive processes and apparatus are not to be construed as limited thereby. It will be readily apparent to those of ordinary skill in the art that various modifications to the foregoing exemplary embodiments may be made without departing from the scope of the invention as defined by the appended claims, with equivalents of the claims to be included therein.

What is claimed is:

1. A display device comprising:

a plurality of data lines;

a transmission gate element comprising a first transmission gate, a second transmission gate, and a third transmission gate each supplying a precharge voltage and a data voltage to each of the data lines in response to a transmission gate signal;

a first transmission gate signal line connected to the first transmission gate, a second transmission gate signal line connected to the second transmission gate, and a third transmission gate signal line connected to the third transmission gate, wherein the first, second and third transmission gate signal lines transmit the transmission gate signal; and a plurality of pixels connected to the data lines, wherein a pixel of the plurality of pixels includes a capacitor, wherein the first, second and third transmission gates are simultaneously turned on to apply the precharge to the data lines in a first period, and then, the first, second and third transmission gates are sequentially turned on to apply the data voltages to the data lines in a second period, and a reference voltage is applied to the capacitor in a third period following the second period.

2. The device of claim 1, further comprising a transmission gate driver supplying the transmission gate signal to the first, second and the third transmission gate signal lines.

3. The device of claim 1, wherein the precharge voltage is equal to or larger than a predetermined maximum value of the data voltage.

4. The device of claim 1, further comprising a plurality of data driving lines, and a data driver connected to the data driving lines, wherein the data driver supplies the precharge voltage and the data voltage to the data driving lines, and wherein the data driving lines are connected to the transmission gate element.

5. The device of claim 4, wherein the data driver supplies the precharge voltage and the data voltage to the respective data driving lines in sequence.

6. The display device of claim 1, wherein the pixel further includes a light emitting element, a first switching transistor, a second switching transistor, a third switching transistor, a fourth switching transistor, and a driving transistor having a control terminal connected to the capacitor, an input terminal, and an output terminal, the driving transistor supplies a driving current to the light emitting element, the first switching transistor connects one of the data lines to the capacitor in response to a gate signal, the second switching transistor connects between the control terminal of the driving transistor and the output terminal of the driving transistor in response to the gate signal, the third switching transistor supplies the reference voltage to the capacitor in response to the gate signal, and the fourth switching transistor connects the output terminal of the driving transistor to the light emitting element in response to the gate signal.

7. The device of claim 6, wherein the precharge voltage, the data voltage, and the reference voltage are applied to the capacitor, and wherein the capacitor stores a charging voltage based on the applied voltage and a threshold voltage of the driving transistor.

8. The device of claim 6, wherein the input terminal of the driving transistor is connected to a driving voltage, and the charging voltage is obtained by deducting an absolute value of the threshold voltage of the driving transistor from the driving voltage.

9. The device of claim 8, wherein the gate signal includes a high voltage and a low voltage, and the low voltage turns on the first and second switching transistors and turns off the third and fourth switching transistors, and the high voltage turns off the first and second switching transistors and turns on the third and fourth switching transistors.

10. The device of claim 6, wherein the reference voltage is equal to or smaller than a predetermined minimum value of the data voltage.

11. The device of claim 6, wherein the first, second, third, and fourth switching transistors and the driving transistor are poly-Si thin film transistors.

12. The device of claim 11, wherein the first switching transistor and the second switching transistor are P-type thin film transistors, and wherein the third switching transistor and the fourth switching transistor are N-type thin film transistors.

13. The device of claim 6, wherein the light emitting element includes an organic light emitting layer.

14. The device of claim 6, wherein the first and second switching transistors are turned on after the first, second and third transmission gates are simultaneously turned on.

15. The device of claim 6, wherein the third and fourth switching transistors are turned on after the first, second and third transmission gates are sequentially turned on.

16. A display device comprising:

a transmission gate that supplies a precharge voltage and a data voltage;

a capacitor;

a light emitting element;

a driving transistor having an input terminal connected to a driving voltage, a control terminal connected to the capacitor, and an output terminal;

a first switching element that operates in response to a gate signal and is connected between the transmission gate and the capacitor;

a second switching element that operates in response to the gate signal and is connected between the control terminal and the output terminal of the driving transistor;

a third switching element that operates in response to the gate signal and is connected between a reference voltage and the capacitor; and a fourth switching element that operates in response to the gate signal and is connected between the output terminal of the driving transistor and the light emitting element, wherein the precharge voltage is applied to the capacitor in a first period of three periods that are continued in sequence, the data voltage is applied to the capacitor in a second period, and the reference voltage is applied to the capacitor in a third period.

17. The device of claim 16, wherein the transmission gate and the first and second switching elements are turned on in the first and second periods, and are turned off in the third period.

18. The device of claim 17, wherein, in the first period, the first and second switching elements are turned on after the transmission gate is turned on.

19. The device of claim 17, wherein the third and fourth switching elements are turned on after the transmission gate is turned off.

20. A method of driving a display device, which includes a transmission gate, and each pixel of the display device includes a capacitor, a light emitting element, a first switching transistor, a second switching transistor, a third switching transistor, a fourth switching transistor, a driving transistor having a control terminal connected to the capacitor, a first terminal connected to a driving voltage, and a second terminal, the method comprising the steps of:

(A) applying a precharge voltage and a data voltage to the transmission gate in sequence;

(B) connecting between the transmission gate and the capacitor by applying a gate signal to a first switching transistor of a pixel of the display device when the precharge voltage and the data voltage are applied to the transmission gate;

(C) connecting between the control terminal and the second terminal of the driving transistor by applying the gate signal to a second switching transistor of the pixel;

(D) connecting the capacitor to a reference voltage by applying the gate signal to a third switching transistor of the pixel after the application of the data voltage to the transmission gate; and (E) connecting between the second terminal of the driving transistor and the light emitting element by applying the gate signal to a fourth switching transistor of the pixel.

21. The method of claim 20, wherein the precharge voltage is equal to or larger than a maximum value of the data voltage, and the reference voltage is equal to or smaller than a minimum value of the data voltage.

22. The method of claim 21, wherein the step (B) is performed after the precharge voltage is applied to the transmission gate.

23. The method of claim 22, wherein the step (D) includes a sub-step of disconnecting between the transmission gate and the capacitor, and wherein the step (E) includes a sub-step of disconnecting the control terminal and the second terminal of the driving transistor.

* * * * *